US005735023A

United States Patent [19]

Smith

[11] Patent Number: 5,735,023

[45] Date of Patent: Apr. 7, 1998

[54] BELT BUCKLE

[76] Inventor: Warner M. Smith, Rte. 1, Box 359, Bristow, Okla. 74010

[21] Appl. No.: 822,985

[22] Filed: Mar. 21, 1997

[51] Int. Cl.[6] ..... A44B 11/00

[52] U.S. Cl. ..... 24/170; 24/163 K; 24/178

[58] Field of Search ..... 24/170, 178, 163 K

[56] References Cited

U.S. PATENT DOCUMENTS

| | | | |
|---|---|---|---|
| 862,571 | 8/1907 | Mathers | 24/170 |
| 1,072,717 | 9/1913 | Hartmann | 24/170 |
| 2,926,408 | 3/1960 | Smith . | |
| 4,733,440 | 3/1988 | Ogawa | 24/170 |

FOREIGN PATENT DOCUMENTS

| | | | |
|---|---|---|---|
| 1411137 | 8/1965 | France | 24/170 |
| 0009980 | 3/1894 | United Kingdom | 24/170 |

*Primary Examiner*—Victor N. Sakran
*Attorney, Agent, or Firm*—William S. Dorman

[57] ABSTRACT

A clamping buckle for a belt comprising a horizontally extending vertical buckle plate having a convex front surface, a concave rear surface, upper and lower horizontally extending integral flanges extending rearwardly from the buckle plate, the flanges having upper and lower surfaces, a first horizontal pivot plate attached to the upper surface of the lower flange, a second horizontal pivot plate attached to the lower surface of the upper flange, each pivot plate having a pair of horizontally spaced pivot holes, first and second vertical leaf members each having an inner vertical edge located adjacent and parallel to the rear surface of the buckle plate, each leaf member being formed with a vertical slot therein, each leaf member having lugs at upper and lower ends of the vertical edge thereof, the lugs of the first leaf member being received in a first pair of opposed pivot holes in the upper and lower pivot plates, the lugs of the second leaf member being received in a second pair of opposed pivot holes in the upper and lower pivot plates, the belt being secured at one end to the first leaf member and having its free end threaded rearwardly of the buckle plate through the slot in the second leaf member and then through the slot in the first leaf member between the buckle plate and the one end of the belt whereby to clamp the belt when the leaf members are rotated away from each other and towards the buckle plate.

2 Claims, 2 Drawing Sheets

10
16
54
34
36
24
20
22
44
12
42
52
54
50

36
34
38
38
40
35
40

34
36
38
18
30
46
44
42
14
12
16
20
43
35

34
16
35
20
18
43
30
14
42
12

10
14
42
44
36
34

BELT BUCKLE

BACKGROUND OF THE INVENTION

1. Field of the Invention

The present invention relates to a belt buckle. More particularly, the present invention relates to a belt buckle of the clamping type.

2. The Prior Art

The number and different types of belt buckles are quite numerous. The present invention relates particularly to an improvement over the belt buckle disclosed in prior U.S. Pat. No. 2,926,408; issued on Mar. 1, 1960 to Warner M. Smith, and entitled "CLAMPING BELT BUCKLE." The belt buckle of the prior patent is similar to the present invention in that it has a curved buckle plate, and a pair of pivotal leaves that fold, in one position, against the concave rear surface of the buckle plate. In another position, these leaves can move out away from the buckle plate when they serve to engage the belt and clamp it in position around the body of the wearer. The difference between the patented belt buckle and the belt buckle of the present invention involves the manner and means, whereby the folding leaves are pivotally attached to the buckle plate.

In U.S. Pat. No. 2,926,408, the two leaf members 17 and 21 are pivotally attached to the main body 12 of the belt buckle by the use of a "H"-shaped bracket member 14, which is provided with wings. Lugs 16' are attached to the upper and lower ends of the wings and the ends of the leaf members are provided with lugs which are received in holes in the lug member. In the patent, the bracket 14 is secured to the rear concave face of the belt buckle.

As will hereinafter appear, the present invention is considerably simpler than the belt buckle of the prior patent, in that the folding leaves are attached to the buckle plate through the use of pivot plates which are secured to the upper and lower flanges of the buckle plate.

SUMMARY OF THE INVENTION

The present invention involves a clamping buckle for a belt comprising of a curved horizontally extending vertical buckle plate having a convex front surface and a concave rear surface. The buckle plate is provided with an upper horizontally extending integral flange extending rearwardly from the buckle plate and a lower horizontally extending integral flange also extending rearwardly from the buckle plate. A first horizontal pivot plate is attached to the upper surface of the lower flange and a second horizontal pivot plate is attached to the lower surface of the upper flange, each pivot plate having a pair of horizontally spaced pivot holes. A first vertical leaf member having an inner vertical edge is positioned adjacent and parallel to the concave rear surface of the buckle plate. The inner edge of the first leaf member is pivotally connected to a first pair of opposed pivot holes in the upper and lower pivot plates, the first leaf member being formed with a vertical slot. A second vertical leaf member having an inner vertical edge is positioned adjacent and parallel to the concave rear surface of said buckle plate. The inner edge of the second leaf member is pivotally connected to a second pair of opposed pivot holes in the upper and lower pivot plates, the second leaf member being formed with a vertical slot. The belt is secured at one end to the first leaf member with its free end threaded rearwardly of the buckle plate through the slot in the second leaf member, and then through the slot in the first leaf member between the buckle plate and the one end of the belt, whereby to clamp the belt when the leaf members are rotated away from each other and towards the buckle plate.

DETAILED DESCRIPTION OF THE PREFERRED EMBODIMENTS

Figures 1, 2, 3, 8, 9:
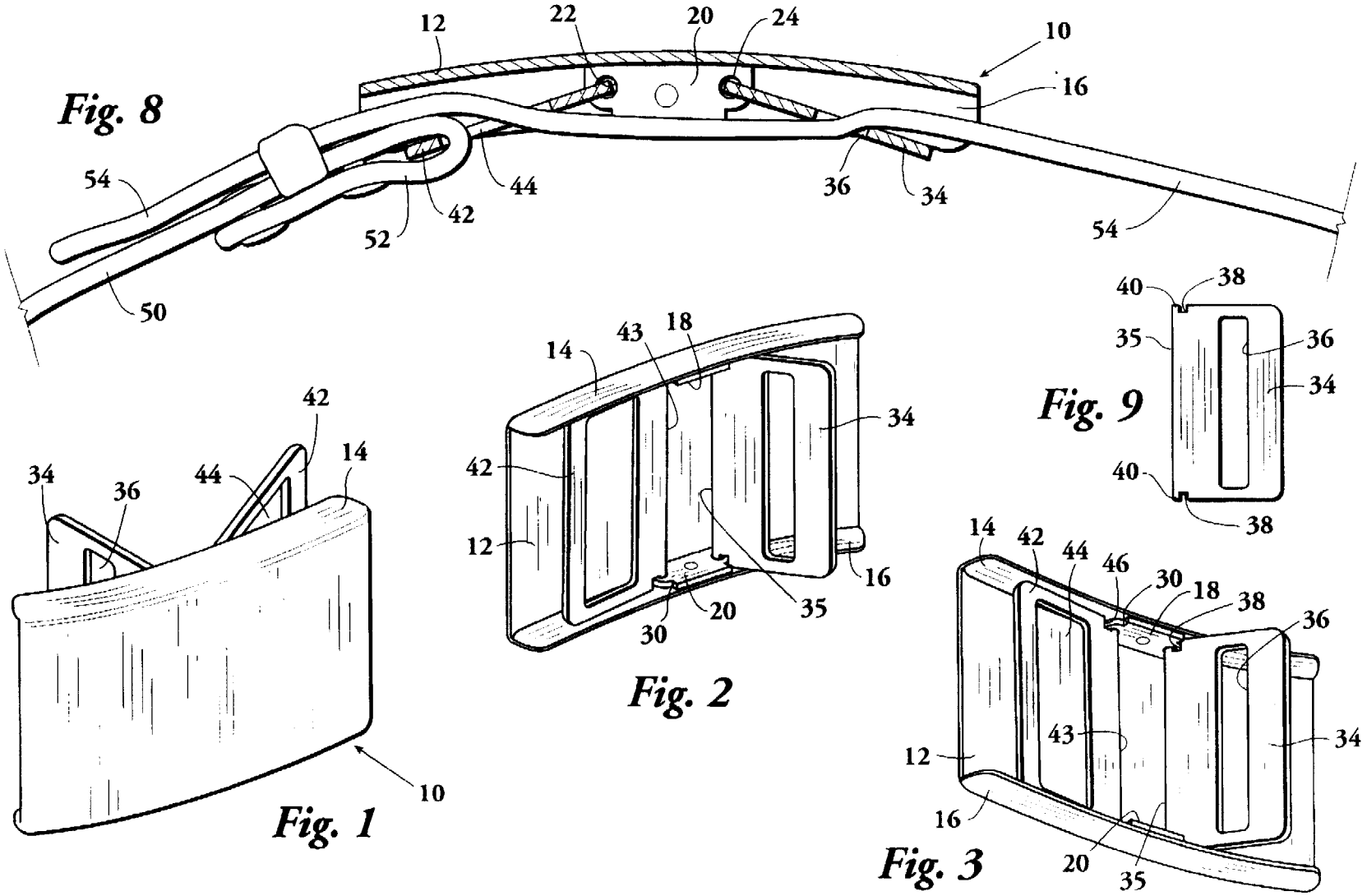
FIG. 1 is a perspective view of the belt buckle of the present invention looking at the front convex side of the buckle plate and showing the pivotal leaves extending rearwardly at an angle to the buckle plate.
FIG. 2 is a perspective view, from the opposite side of FIG. 1, showing one of the pivotal leaves flat against the inside concave surface of the buckle plate, with the other leaf at an angle thereto.
FIG. 3 is a perspective view similar to FIG. 2 but looking at the belt buckle from a lower perspective angle.
FIG. 8 is a view similar to FIGS. 5 through 7 but showing the attachment of a belt to the buckle plate and to the pivotal leaves thereof.
FIG. 9 is an elevation of one of the pivotal leaves by itself.

Referring to the drawings in detail, FIG. 1 shows a buckle 10 comprised of a horizontally extending and curved vertical buckle plate 12. The buckle plate 12 is provided with upper and lower curved horizonal edges from which integral horizonal curved flanges 18 and 20 extend rearwardly, terminating in curved edges which are parallel to the upper curved edges of the buckle plate 12. A pivot plate 18 is attached by spot welding, or any other convenient method, to the lower surface of the upper curve flange 14 at the approximate center of the flange. Similarly, a pivot plate 20 is attached to the upper surface of the lower curved flange 16 at the approximate center thereof.

Figure 5:
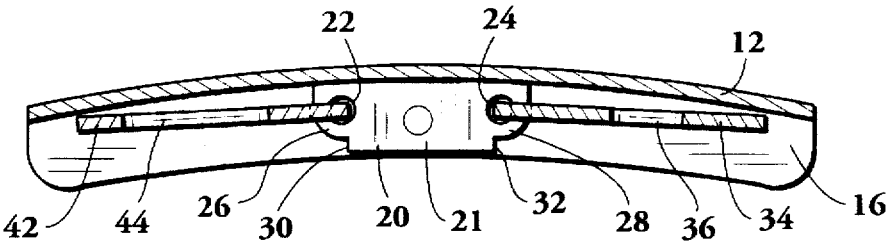
FIG. 5 is a sectional view taken along section line 5 through 5 of FIG. 4.

The pivot plates 18 and 20 are essentially identical and therefore, the following description of the lower pivot plate 20 will apply fully to the upper pivot plate 18. Each pivot plate, such as pivot plate 20, is provided with a pair of holes 22 and 24, which are spaced apart and are located adjacent the opposite ends of the pivot plate. The rear portion of each pivot plate is provided with a rectangular tab 21 having a rear end which is essentially collinear with the rear edge of the flange to which the pivot plate is attached. The opposite sides of the tab 21 are provided with shoulders 30 and 32, which are essentially at right angles to the plane of the buckle plate 12. The ends of the pivot plate (18 or 20) are provided with curved edges 26 and 28 surrounding the holes 22 and 24. The forward portions of the curved edges 26 and 28 are essentially connected to the back surface of the buckle plate at essentially right angles; however, the rearmost portions of these curved edges 26 and 28 merge with the shoulders 30 and 32, as best shown in FIG. 5.

A vertical leaf 34, having a rectangular slot 36 therein, is provided and attached to the pivot plates 18 and 20 in the following manner:

The leaf 34 is provided with an inner vertical edge 35, which is adapted to lie closely adjacent to the rear concave surface of the buckle plate 12. Notches 38 are provided in the upper and lower edges of the leaf 34, slightly spaced from the inner edge 35, and leaving pivot lugs 40 along the inner edge 35. The pivot lugs 40 are adapted to be received in the holes 24 in the pivot plates 18 and 20.

A second leaf member 42 is provided having a rectangular slot 44. The leaf 42 has an inner vertical edge 43 which is adapted to lie closely adjacent the rear curved surface of the buckle plate 12. As was the case with the leaf 34, the leaf 42 is provided with notches 46 spaced away from inner edge 43 a sufficient distance so as to leave lugs 48 at the upper and lower inner edges of the leaf 42. These lugs 48 are adapted to be received in the holes 22 in the upper and lower pivot plates 18 and 20.

Figure 7:
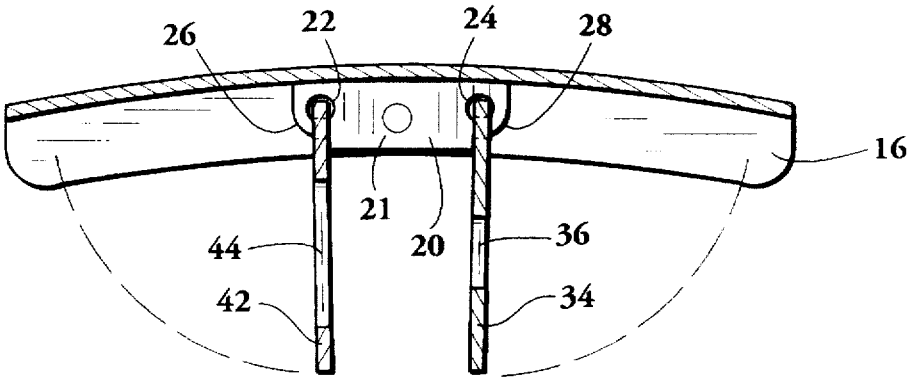
FIG. 7 is a view similar to FIG. 6 but showing the pivotal leaves at their maximum angle with respect to the buckle plate.
Figure 6:
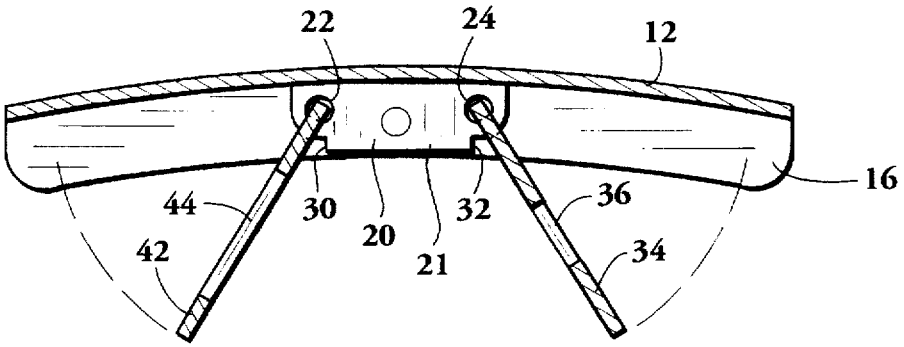
FIG. 6 is a sectional view similar to FIG. 5 but showing the pivotal leaves disposed at an angle with respect to the buckle plate.
Figure 4:
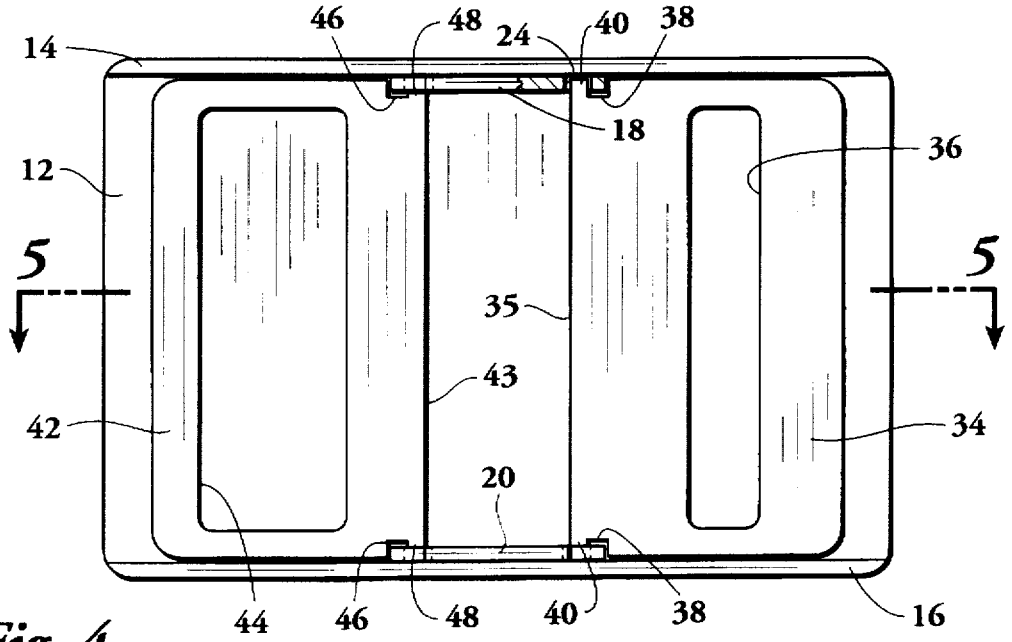
FIG. 4 is a rear elevational view of the belt buckle of the present invention showing the pivotal leaves lying flat against the rear concave surface of the buckle plate.

As best shown in FIG. 4, the widths of the notches 38 and 46 are such that the outboard edges of the notches bear against edges 26 and 28 of the pivot plates 18 and 20. Thus, the leaves 34 and 42 can swing from the position shown in FIG. 5, to the position shown in FIG. 6, and then, ultimately, to the position shown in FIG. 7, at which time the edges of the leaves 42 and 34 contact the shoulders 30 and 32, so as to prevent further inward movement of the leaves beyond the position shown in FIG. 7.

Turning now to FIG. 8, a belt 50, having a buckle end 52 and a free end 54, is secured to the buckle by first arranging the buckle end 52 so that it passes through the slot 44 and then around the solid portion of the leaf 42 to the left of the slot 44. The free end 54 of the belt is then allowed to encircle the wearer until the free end 54 is inserted through the slot 36 in the other leaf 34, then through the slot 44 between the buckle end 52 of the belt and the rear concave surface of the buckle plate 12. The free end of the belt is pulled until it is comfortably around the wearer and then released, at which time the edges of the slot 36 will engage the free end of the belt 54 to hold it in position. It is noted that the slot 44 is somewhat wider than the slot 36, to permit both the free end 54 and the buckle end 52 to be accommodated in the slot 44 of the leaf 42. Obviously, the slot 36 could be made wider if desired. Furthermore, if it were desired to alter or improve the gripping engagement of the slot 36 with respect to the free end of the belt 54, the slot 36 could be provided with serrated edges, such as ends 51 shown in FIG. 10 of Smith U.S. Pat. No. 2,926,408.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached Claim or Claims, including the full range of equivalency to which each element thereof is entitled.

What is claimed is:

1. A clamping buckle for a belt comprising a curved horizontally extending vertical buckle plate having a convex front surface, a concave rear surface, a horizontally extending curved upper edge, a horizontally extending curved lower edge, an upper horizontally extending integral flange extending rearwardly from the buckle plate along the upper curved edge thereof, a lower horizontally extending integral flange extending rearwardly from the buckle plate along the lower curved edge thereof, the flanges having upper and lower surfaces and curved rear edges parallel to the upper and lower curved edges of the buckle plate, respectively, a first horizontal pivot plate attached to the upper surface of the lower flange, a second horizontal pivot plate attached to the lower surface of the upper flange, each pivot plate having a rectangular tab extending rearwardly towards the rear curved end of its associated flange, each tab having a pair of horizontally spaced and rearwardly directed shoulders constituting stops, each pivot plate having a pair of horizontally spaced pivot holes disposed outboard of the shoulders thereof, a first vertical leaf member having an inner vertical edge located adjacent and parallel to the concave rear surface of said buckle plate, means pivotally connecting said inner edge of the first leaf member to a first pair of opposed pivot holes in the upper and lower pivot plates, said first leaf member being formed with a vertical slot, a second vertical leaf member having an inner vertical edge located adjacent and parallel to the concave rear surface of said buckle plate, means pivotally connecting said inner edge of the second leaf member to a second pair of opposed pivot holes in the upper and lower pivot plates, said second leaf member being formed with a vertical slot, said belt being secured at one end to said first leaf member and having its free end threaded rearwardly of the buckle plate through the slot in the second leaf member and then through the slot in the first leaf member between the buckle plate and said one end of the belt whereby to clamp the belt when the leaf members are rotated away from each other and towards said buckle plate, the stops limiting rotation of said leaf members towards each other and preventing such rotation beyond positions wherein the leaf members are at substantial angles to the buckle plate, each pivot plate being provided with a rectangular tab extending rearwardly towards the rear curved end of its associated flange, each tab having a pair of horizontally spaced and rearwardly directed shoulders constituting stops, the stops limiting rotation of said leaf members towards each other and preventing such rotation beyond positions wherein the leaf members are at substantial angles to the buckle plate.

2. A clamping buckle for a belt comprising a curved horizontally extending vertical buckle plate having a convex front surface, a concave rear surface, a horizontally extending curved upper edge, a horizontally extending curved lower edge, an upper horizontally extending integral flange extending rearwardly from the buckle plate along the upper curved edge thereof, a lower horizontally extending integral flange extending rearwardly from the buckle plate along the lower curved edge thereof, the flanges having upper and lower surfaces and curved rear edges parallel to the upper and lower curved edges of the buckle plate, respectively, a first horizontal pivot plate attached to the upper surface of the lower flange, a second horizontal pivot plate attached to the lower surface of the upper flange, each pivot plate having a rectangular tab extending rearwardly towards the rear curved end of its associated flange, each tab having a pair of horizontally spaced and rearwardly directed shoulders constituting stops, each pivot plate having a pair of horizontally spaced pivot holes disposed outboard of the shoulders thereof, a first vertical leaf member having an inner vertical edge located adjacent and parallel to the concave rear surface of said buckle plate, means pivotally connecting said inner edge of the first leaf member to a first pair of opposed pivot holes in the upper and lower pivot plates, said first leaf member being formed with a vertical slot, a second vertical leaf member having an inner vertical edge located adjacent and parallel to the concave rear surface of said buckle plate, means pivotally connecting said inner edge of the second leaf member to a second pair of opposed pivot holes in the upper and lower pivot plates, said second leaf member being formed with a vertical slot, said belt being secured at one end to said first leaf member and having its free end threaded rearwardly of the buckle plate through the slot in the second leaf member and then through the slot in the first leaf member between the buckle plate and said one end of the belt whereby to clamp the belt when the leaf members are rotated away from each other and towards said buckle plate, the stops limiting rotation of said leaf members towards each other and preventing such rotation beyond positions wherein the leaf members are at substantial angles to the buckle plate.

* * * * *